United States Patent [19]

Roe

[11] 4,023,288

[45] May 17, 1977

[54] BACKHOE COMPACTOR/SCRAPER APPARATUS AND METHOD

[76] Inventor: Harry James Roe, 902 Wateka Way, Richardson, Tex. 75080

[22] Filed: Apr. 11, 1975

[21] Appl. No.: 567,135

Related U.S. Application Data

[62] Division of Ser. No. 442,763, Feb. 15, 1974, Pat. No. 3,891,342.

[52] U.S. Cl. ..... 37/117.5; 37/DIG. 3; 37/103; 37/142.5; 172/464; 214/131 R; 214/DIG. 5; 37/195

[51] Int. Cl.[2] ..... E02F 3/76; B66F 9/00

[58] Field of Search ..... 37/117.5, 142.5, 189, 37/DIG. 3, 195, 103; 172/464, 554; 214/138 R, 145, DIG. 5, 131 R

[56] References Cited

UNITED STATES PATENTS

| | | | |
|---|---|---|---|
| 2,495,310 | 1/1950 | Armington | 37/142.5 X |
| 2,537,802 | 1/1951 | Thomas | 172/554 X |
| 2,585,117 | 2/1952 | Gurries | 37/DIG. 3 |
| 2,891,335 | 6/1959 | Linneman | 37/142.5 |
| 3,297,096 | 1/1967 | Wooldridge | 172/464 |
| 3,471,953 | 10/1969 | Wyatt | 37/142.5 |
| 3,481,056 | 12/1969 | Meade et al. | 37/117.5 |
| 3,595,411 | 7/1971 | Ables | 214/145 |
| 3,767,262 | 10/1973 | Pewtith | 37/189 |
| 3,828,835 | 8/1974 | Cross, Sr. | 214/145 X |
| 3,845,796 | 11/1974 | Moore | 37/141 X |

*Primary Examiner*—E. H. Eickholt
*Attorney, Agent, or Firm*—Hubbard, Thurman, Turner & Tucker

[57] ABSTRACT

A compaction roller is provided for attachment to a backhoe or similar boom device mounted on a tractor for compacting loose fill dirt. The roller includes a closed cylinder mounted on a free wheeling axle having a plurality of radially extending teeth spaced about its circumference. A U-shaped attachment member is connected to both ends of the axle and is provided with two comb assemblies extending across the cylinder width having teeth spaced to clean the cylinder teeth as the cylinder rotates. The attachment member extends in a tapering U-shape to form a scraper blade integral with the attachment member for scraping fill dirt into a trench for compaction. Downward pressure is provided by the backhoe hydraulic piston assembly and the partial weight of the tractor at the backhoe is rotated over a section of fill dirt in the trench.

8 Claims, 8 Drawing Figures

BACKHOE COMPACTOR/SCRAPER APPARATUS AND METHOD

This is a division of application Ser. No. 442,763, filed Feb. 15, 1974, now U.S. Pat. No. 3,891,342.

BACKGROUND AND SUMMARY OF THE INVENTION

This invention relates to a compactor apparatus and more particularly to a backhoe compactor/scraper apparatus and method for compacting loose fill material.

As land is developed and new buildings are built, numerous underground pipelines must be laid. Long trenches as deep as 6 feet are dug, and pipelines are laid, connected and tested. When the trenches are refilled, the dirt must be closely packed to prevent later settling. A loosely-packed trenchline running beneath a building may settle and crack the building foundation necessitating long and costly repairs. Substantial damage and delay may also result from settling earth in loosely filled trenches under roadways and parking lots.

To achieve sufficient compacting, trenches are often filled and packed in layers using a tractor with a scraper and a manually operated jackhammer. Each layer of fill dirt is pushed into the ditch by the scraper and then compacted by the jackhammer. This process is quite slow and requires at least two men to operate the machinery. Compactor apparatus are sometimes used which attach to a backhoe and vibrate to settle the earth. The bulkiness and weight of these apparatus, as well as their high cost, have rendered them impractical for many jobs. Furthermore, substantial equipment maintenance is required because of the damage caused by continuous vibration.

The present invention comprises a simple and efficient compactor/scraper connected to a backhoe for moving and packing fill dirt into trenches. The invention includes a compaction roller adapted for backhoe attachment having radially projecting teeth spaced around the roller circumference. At least one comb assembly is provided for cleaning packed dirt from between the roller teeth. The compactor has a scraper member attached to the backhoe for pushing fill dirt into the trenches.

In accordance with another aspect of the present invention, a closed cylinder is mounted on a free wheeling axle and has a plurality of radially projecting steel teeth evenly spaced around the cylinder circumference. A backhoe attachment member connected to both ends of the axle includes two comb assemblies having teeth spaced to fit between the cylinder teeth for cleaning. A scraper integral with the attachment member extends adjacent a portion of the cylinder to act in cooperation with the hydraulic system of the backhoe to move fill dirt.

In accordance with a further aspect of the present invention, a method of filling trench excavations utilizes a backhoe compactor/scraper mounted on a hydraulically-actuated boom assembly on a tractor.

A layer of fill material is raked into a portion of the trench and evenly distributed using the backhoe compactor/scraper. The compactor/scraper is positioned on the layer of fill material in the trench and substantial downward pressure including the partial weight of the tractor is applied through the boom assembly. The compactor/scraper is rolled over the layer of fill material until it has been sufficiently compacted. Conglomerated fill material is broken up during compaction by radially projecting teeth on the compactor/scraper.

DESCRIPTION OF THE DRAWINGS

A more complete understanding of the invention may be had by referring to the following detailed description taken in conjunction with the drawings wherein:

Referring now to FIGS. 1 and 2, the compactor/scraper 10 of the present invention includes a cylindrical compaction roller 12 connected to a backhoe attachment member 13. Small, cylindrical teeth 14 are spaced evenly around the circumference of roller 12 in alternate transverse rows of three and four teeth, respectively. Teeth 14 project radially outward from roller 12 for concentrating pressure to ensure that fill dirt is even and compact.

Figure 1:
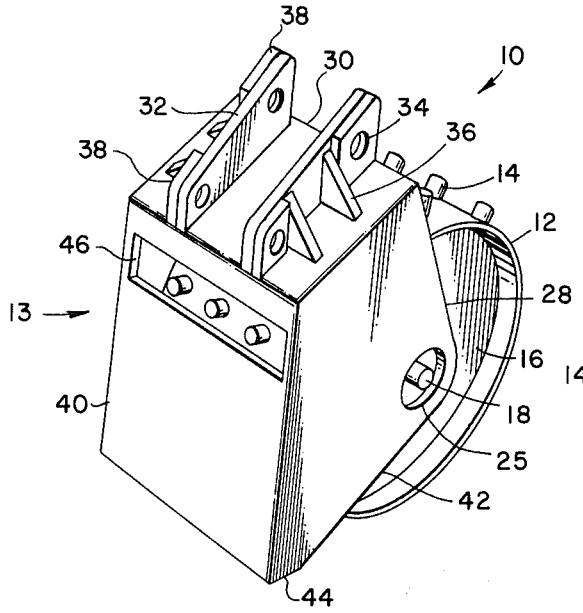
FIG. 1 is a front perspective view of the backhoe compactor/scraper of the present invention.
Figure 2:
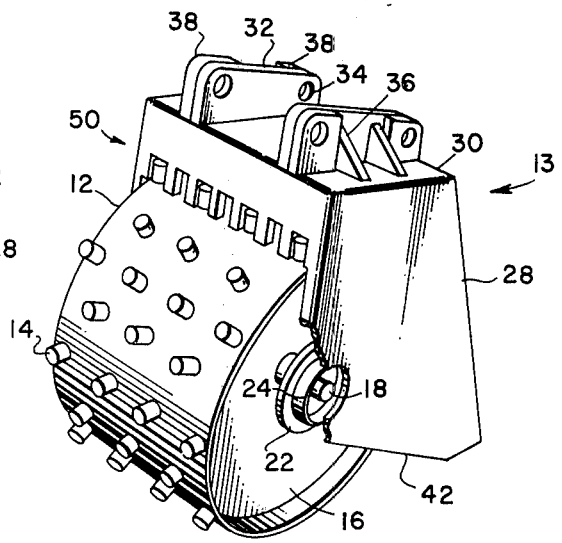
FIG. 2 is a rear perspective view of the backhoe compactor/scraper of FIG. 1.

Roller 12 is closed at both ends by circular plates 16 which are inset a short distance from the ends of roller 12 and welded to the interior of the roller. A free-wheeling axle 18 extends through an aperture in both circular plates 16 and has wheel plates 22 concentrically mounted near each end. A cylindrical axle extension 24 projects outward from each wheel plate 22 to connect to attachment member 13.

Member 13 includes side plates 28 extending parallel to the ends of roller 12 and attaching on the interior surfaces to the axle extensions 24. An aperture 25 in each side plate 28 exposes an end of the axle 18 for servicing.

Side plates 28 are connected by yoke 30 extending transversely between the upper ends of each side plate 28 above roller 12. Two attachment brackets 32 are mounted on yoke 30 to extend upward normal to yoke 30 for connecting to a backhoe assembly. Each bracket 32 has two bolt holes 34 in alignment with the corresponding holes 34 in the opposite attachment bracket 32. Two braces 36 are attached to the outside of each bracket 32 tapering upward from yoke 30 to end near bolt holes 34. Two reinforcement strips 38 are attached flush with the outside of each bracket 32 along the portions having holes 34, to strengthen the brackets 32.

A scraper plate 40 provides a rear wall for attachment member 13 being connected substantially at right angles to yoke 30 and side plates 28 to form a U-shaped enclosure for a portion of compaction roller 12. The lower portions 42 of side plates 28 taper toward scraper plate 40 truncating to form, with the lower end of scraper plate 30, a U-shaped scraper blade 44 positioned slightly above the bottom of roller 12 when compactor 10 is in the upright compacting position. A window 46 extends transversely across the entire length of scraper plate 40 near yoke 30 to facilitate cleaning and to provide an exit for trapped dirt.

Figure 4:
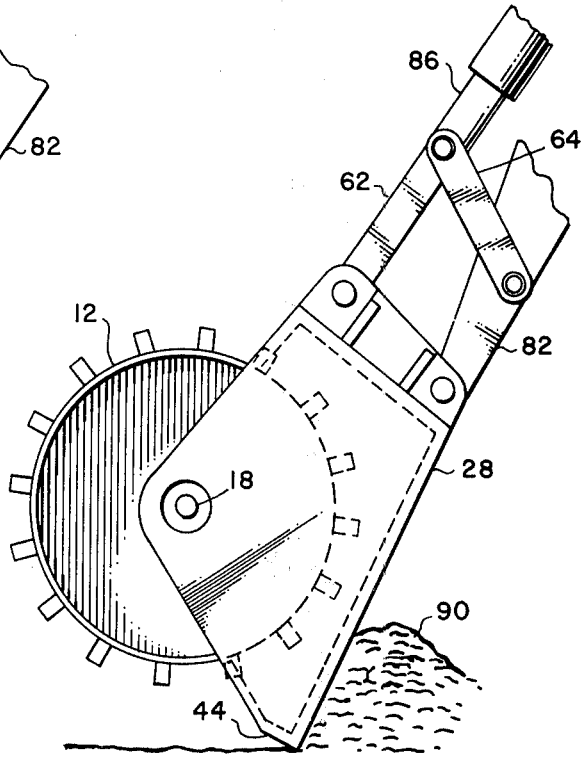
FIG. 4 is a side view of the invention of FIG. 3 showing the compactor/scraper in a tilted scraping position.
Figure 5:
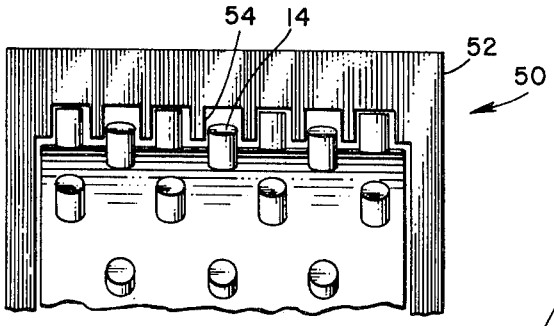
FIG. 5 is a detail partial view of the comb assembly and roller of the present invention.

A comb assembly 50, best shown in FIG. 5, includes a rectangular comb piece 52 attached across the back of yoke 30 and extending downward toward roller 12. Six evenly spaced comb teeth 54 project downward below the ends of roller teeth 14 to within a short distance of the surface of roller 12. Comb teeth 54 are spaced apart sufficiently to allow a roller tooth 14 pass between each adjacent pair of comb teeth, so as to clean dirt and mud from between the roller teeth 14 as roller 12 is worked over a layer of fill dirt. A similar comb assembly 58 (FIG. 4) is attached across between the side plates 28 near scraper blade 44 to clean dirt and mud from the roller teeth 14 on that part of the roller.

In a preferred embodiment of the present invention, the cylindrical roller 12 is made of a 21 inch length of 30 inch steel pipe. Circular plates 16 closing the ends of roller 12 are made of ½ inch thick steel plate. Yoke 30 and side plates 28 are ⅝ inch steel plate welded to a ½ inch steel scraper plate 40. Attachment brackets 32 are ⅝ inch steel plate strengthened by ⅝ inch reinforcement strips 38. Roller teeth 14 are made of 2 inch long solid steel bars 1½ inches in diameter welded to roller 12 at evenly spaced 6 inch intervals. Comb piece 52 is a ½ inch steel plate with ½ inch thick comb teeth 54 spaced three inches apart.

Axle 18 is a modified trailer axle, 1¾ inch in diameter with a load capacity of at least 4000 pounds. Four sets of sealed steel roller bearings (not shown) provide unrestrained axle rotation.

Figure 3:
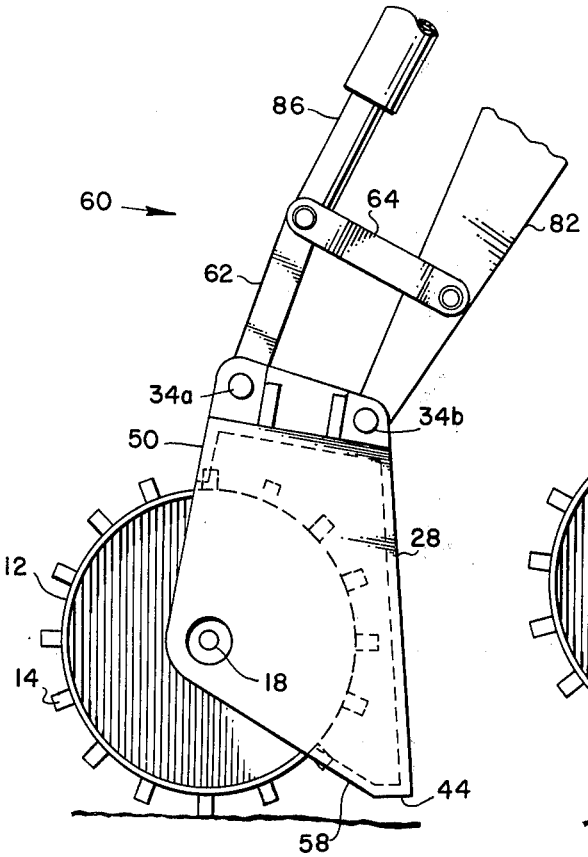
FIG. 3 is a side view of the compactor/scraper of FIG. 1 attached to a backhoe in an upright compacting position.

FIG. 3 shows compactor/scraper 10 attached in the upright position to a backhoe hydraulic assembly 60. The lower bolt holes **34*b* in each attachment bracket 32 are pivotally connected to a rigid crowd boom 82 of the backhoe. A hydraulic compactor piston 86 is pivotally attached to a pivot member 62 which in turn is connected to the upper pair of bolt holes 34*a* of each bracket 32. A cross brace 64 runs between the connection point of piston 86 and pivot member 62 and crowd boom 82**.

In the position shown in FIG. 3, roller teeth 14 of compaction roller 12 contact the ground and scraper blade 44 is maintained above the earth surface. In FIG. 4, piston 86 has been retracted to rotate the position of compactor/scraper 10 relative to the ground. Scraper blade 44 projects downward below roller 12 to contact fill dirt 90. Roller 12 is consequently raised out of ground contact in this position.

Figure 6:
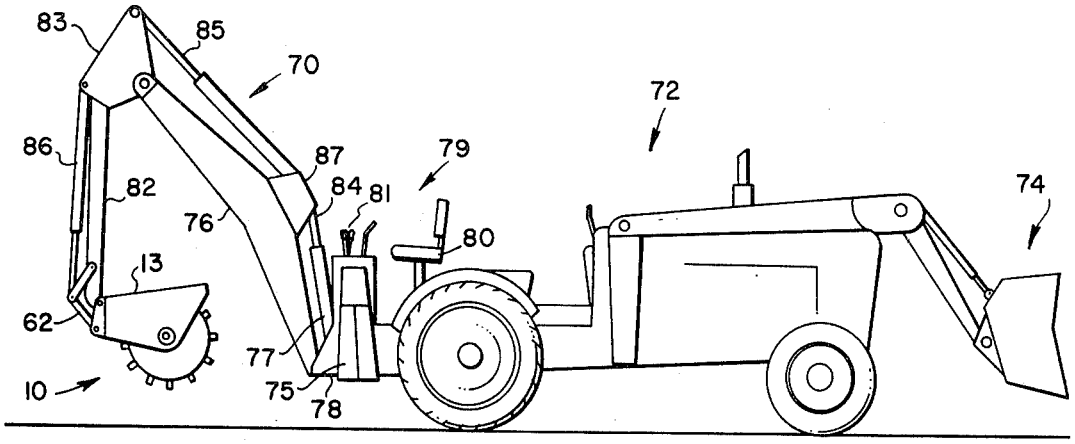
FIG. 6 is a pictorial view of the compactor/scraper of the present invention mounted on a tractor backhoe assembly in position for transporting.
Figure 7:
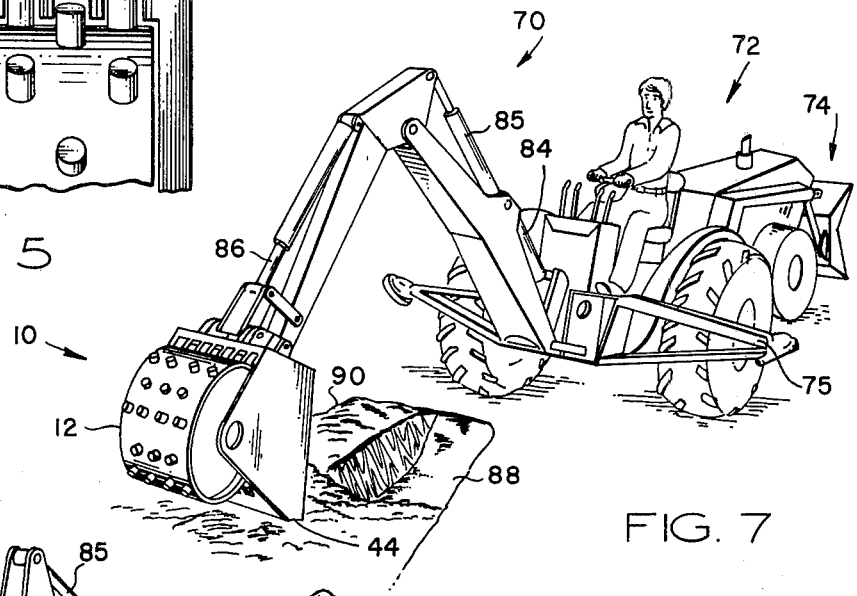
FIG. 7 is a pictorial view of the compactor/scraper of FIG. 6 showing the scraper portion of the invention in operation.
Figure 8:
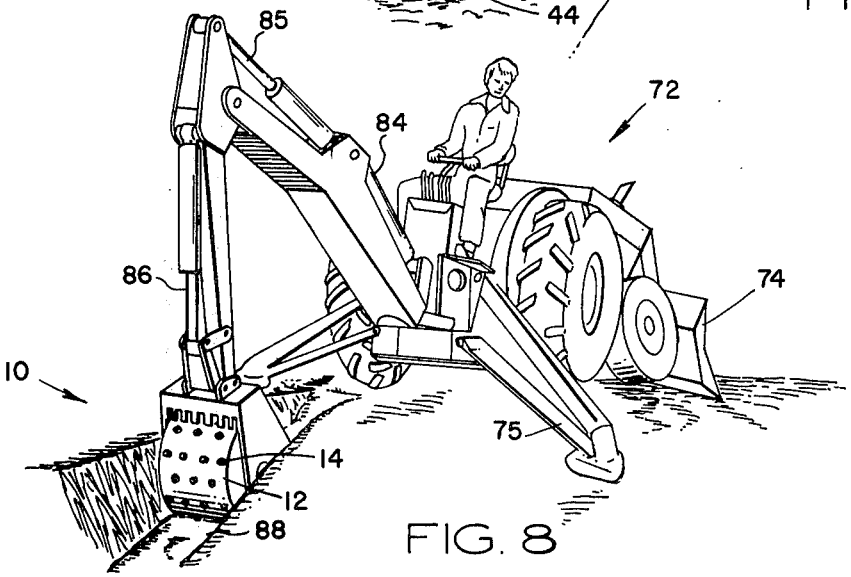
FIG. 8 is a pictorial view of the compactor/scraper of FIG. 6 showing the roller portion of the invention in operation.

FIGS. 6, 7 and 8 show how the present invention is mounted and operated with a backhoe assembly. In FIG. 6, the compactor/scraper 10 is mounted in transporting position on a backhoe assembly 70 which is connected to the back of a tractor 72. A hydraulically-operated scoop bucket 74 is mounted on the front of tractor 72 for moving fill dirt as required.

Backhoe assembly 70 comprises a lift boom 76 pivotally mounted to tractor 72 by a mounting member 78. An operator's station 79 with a rearward facing seat 80 and hydraulic controls 81 is positioned above mounting member 78. Two outrigger arms 75, shown in raised position, extend from either side of mounting member 78 and terminate in stabilizer pad 77. A crowd boom 82 is pivotally attached to the remote end of lift boom 76 by a hinge member 83. Attachment member 13 and crowd boom 82 are connected as described in connection with FIG. 3. A thrust piston 84 extends from mounting member 78 to a connection point 87 in the middle of lift boom 76. A hydraulic hinge piston 85 is connected between hinge member 83 and connection point 87 allowing hinge member 83 to pivot and thus rotating crowd boom 82. Hydraulic compactor piston 86 is mounted between hinge member 83 and pivot member 62 for rotating the compactor/scraper 10 to adjust its orientation relative to the ground. In FIG. 6, compactor piston 86 is fully extended to curl compactor/scraper 10 beneath backhoe assembly 70 for transporting.

FIG. 7 shows the compactor/scraper 10 in the scraping position. Tractor 72 is backed up to a trench 88 which may have been previously dug by a shovel connected to backhoe assembly 70. Scoop bucket 74 and outriggers 75 remain raised to facilitate mobility of the tractor. Compactor piston 86 is retracted to rotate compactor/scraper 10 so that scraper blade 44 is positioned below roller 12. Thrust piston 84 and hinge piston 85 are selectively extended and retracted to work scraper blade 44 across a mound of fill dirt 90 next to trench 88 in order to rake the dirt into the trench. Scraper blade 44 is also utilized to smooth out the fill dirt in trench 88 to form an evenly distributed loose dirt layer, called a lift, usually about 12–18 inches deep.

After the lift has been prepared the compactor piston 86 is extended slightly to rotate the compactor/scraper 10 to the roller position as shown in FIG. 8. The compactor/scraper 10 is placed in trench 88 and thrust piston 84 is extended to apply downward pressure on the roller 12. As much as 4000 pounds of downward pressure can be exerted on roller 12 by utilizing the weight of tractor 72. As shown in FIG. 8 the full downward force of thrust piston 84 raises all four wheels of tractor 72 and outriggers 75 off the ground, leaving scoop bucket 74 and roller 12 as the sole ground contact points for the entire machine. Hinge piston 85 is extended and retracted to rotate roller 12 over the lift surface and compact the fill dirt. Roller teeth 14 apply concentrated pressure to break up any dirt clumps and facilitate packing. After the lift has been sufficiently compacted, thrust piston 84 is released to lower tractor 72 and outriggers 75 to the ground. The scraper blade 44 is used to pull more fill dirt into trench 86 and the process is repeated until trench 88 has been filled.

It is understood from the foregoing description that the compactor/scraper of the present invention provides several important advantages over other systems. Using the described compactor/scraper apparatus attached to a tractor backhoe system, a trench can be filled much more rapidly than with a jackhammer. As an example, a six foot deep trench about 50 feet long and 2 feet wide can be filled in about two hours using the present invention in comparison to a requirement of about three days for the same job using a jackhammer. Moreover, the present invention requires only one operator to fill in and compact the dirt whereas two or more men are usually needed for other systems. The present invention also provides a means of alternately pushing fill dirt into a trench and compacting the fill dirt without the necessity of substantial relocation or movement of heavy machinery. Furthermore, the scraper of the present invention can be used to move fill dirt in narrow and restricted areas which would be inaccessible if the tractor front scoop bucket were used.

Although a particular embodiment of the invention has been illustrated in the accompanying drawings and described in the foregoing description, it will be understood that the dimensions of the present invention are flexible and can be modified as needed for any size or depth of trench or for backhoe types different from the one shown. The invention is not limited to the embodiment disclosed, but is capable of rearrangement, modification and substitution without departing from the spirit of the invention.

What is claimed is:

1. A method of filling trench excavations using a backhoe compactor attached to a hydraulically-actuated boom assembly mounted on a tractor, comprising scraping a layer of fill material into a portion of said trench with a scraper blade on said backhoe compactor; and compacting said layer of fill material in said trench by applying a substantial amount of the tractor weight through said boom assembly to a cylindrical roller on said backhoe compactor while moving the roller over the fill material in the trench.

2. The method of claim 1 wherein substantially the entire weight of said tractor is distributed between said cylindrical roller through the boom assembly and a work member on the front of the tractor.

3. The method of claim 2 wherein said substantial amount of tractor weight is transferred to said roller along a substantially straight line running along a boom of the boom assembly to said roller.

4. A method of filling trench excavations using a backhoe compactor attached to a hydraulically-actuated boom assembly mounted on a tractor, comprising scraping a layer of fill material into a portion of said trench with a scraper blade on said backhoe compactor; and compacting said layer of fill material in said trench by applying downward pressure, including a substantial amount of weight of said tractor, along a boom of said backhoe assembly to a cylindrical roller on said backhoe compactor in substantial alignment with said backhoe boom while moving said backhoe boom along the trench to run the roller over the fill material.

5. A method of filling trench excavations using a backhoe compactor attached to a hydraulically-actuated boom assembly mounted on a tractor, comprising scraping a layer of fill material into a portion of said trench with a scraper blade on said backhoe compactor; and compacting said layer of fill material in said trench using a cylindrical roller pivotally attached to a boom of said backhoe assembly by positioning said roller substantially along the longitudinal axis of said boom and applying a force directed substantially parallel to said boom along a line running substantially through the center of said cylindrical roller while moving said backhoe boom along the trench to run the roller over the fill material.

6. The method of claim 5 wherein the step of applying substantial downward pressure includes applying a substantial amount of weight of said tractor on said roller through said boom assembly.

7. The method of claim 5 and further comprising the step of distributing the layer of fill dirt evenly over a portion of said trench using said scraper blade.

8. The method of claim 5 and further comprising the step of breaking up lumps of conglomerated fill material using roller teeth projecting radially from said roller while compacting said layer of fill material in said trench.

* * * * *